US008387384B2

(12) United States Patent
Quigley et al.

(10) Patent No.: US 8,387,384 B2
(45) Date of Patent: Mar. 5, 2013

(54) PRESSURE ESTIMATION SYSTEMS AND METHODS

(75) Inventors: David P. Quigley, Brighton, MI (US); Steven J. Andrasko, Wixom, MI (US); Thomas L. Bahensky, Plymouth, MI (US); Yun Xiao, Ann Arbor, MI (US)

(73) Assignee: GM Global Technology Operations LLC

( * ) Notice: Subject to any disclaimer, the term of this patent is extended or adjusted under 35 U.S.C. 154(b) by 532 days.

(21) Appl. No.: 12/692,925

(22) Filed: Jan. 25, 2010

(65) Prior Publication Data

US 2011/0067396 A1 Mar. 24, 2011

Related U.S. Application Data

(60) Provisional application No. 61/244,653, filed on Sep. 22, 2009.

(51) Int. Cl.

| | |
|---|---|
| ***F02B 33/44*** | (2006.01) |
| ***F02B 33/00*** | (2006.01) |
| ***F02B 47/08*** | (2006.01) |
| ***F02M 25/07*** | (2006.01) |

(52) U.S. Cl. ..... 60/611; 60/605.1; 60/605.2; 123/564; 123/568.19

(58) Field of Classification Search ..... 60/598, 60/605.1, 605.2, 611; 123/564, 568.19
See application file for complete search history.

(56) References Cited

U.S. PATENT DOCUMENTS

| | | | | |
|---|---|---|---|---|
| 2006/0293827 | A1 * | 12/2006 | Frauenkron et al. | 701/103 |
| 2009/0090106 | A1 * | 4/2009 | Muller | 60/602 |
| 2009/0192693 | A1 * | 7/2009 | Bottcher et al. | 701/102 |
| 2009/0223495 | A1 * | 9/2009 | Ohata et al. | 123/568.12 |

* cited by examiner

*Primary Examiner* — Kenneth Bomberg
*Assistant Examiner* — Audrey K Bradley

(57) ABSTRACT

An intake control system comprises an estimation module and a turbocharger control module. The estimation module receives one of a first pressure within an intake manifold measured by a manifold pressure sensor and a second pressure measured by a pressure sensor at a location between a compressed air charge cooler and a throttle valve. The estimation module estimates the other one of the first and second pressures based on the received one of the first and second pressures. The turbocharger control module controls output of a turbocharger based on the estimate of the other one of the first and second pressures.

11 Claims, 5 Drawing Sheets

PRESSURE ESTIMATION SYSTEMS AND METHODS

CROSS-REFERENCE TO RELATED APPLICATIONS

This application claims the benefit of U.S. Provisional Application No. 61/244,653, filed on Sep. 22, 2009. The disclosure of the above application is incorporated herein by reference in its entirety.

FIELD

The present disclosure relates to internal combustion engines and more particularly to intake systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into an engine is regulated via a throttle. More specifically, the throttle adjusts throttle area, which increases or decreases the air flow into the engine. As the throttle area increases, the air flow into the engine increases. A fuel control system adjusts the rate that fuel is injected to provide a desired air/fuel mixture to the cylinders. Increasing the amount of air and fuel provided to the cylinders increases the torque output of the engine.

A turbocharger may be implemented in some engine systems to selectively increase the amount of air provided to the engine. The amount of fuel may therefore also be increased, and the turbocharger may allow for increased levels of the torque output by the engine.

SUMMARY

An intake control system for a vehicle comprises a pressure estimation module and a turbocharger control module. The pressure estimation module receives a pressure measured by a compressor outlet pressure sensor at a location downstream from a compressor of a turbocharger and upstream from a throttle valve. The pressure estimation module estimates a manifold pressure within an intake manifold of an engine based on the pressure. The turbo control module controls the turbocharger based on the estimated manifold pressure.

An intake control system comprises an estimation module and a turbocharger control module. The estimation module receives one of a first pressure within an intake manifold measured by a manifold pressure sensor and a second pressure measured by a pressure sensor at a location between a compressed air charge cooler and a throttle valve. The estimation module estimates the other one of the first and second pressures based on the received one of the first and second pressures. The turbocharger control module controls output of a turbocharger based on the estimate of the other one of the first and second pressures.

An intake control method comprises receiving a pressure measured by a compressor outlet pressure sensor at a location downstream from a compressor of a turbocharger and upstream from a throttle valve, estimating a manifold pressure within an intake manifold of an engine based on the pressure, and controlling the turbocharger based on the estimated manifold pressure.

Further areas of applicability of the present disclosure will become apparent from the detailed description provided hereinafter. It should be understood that the detailed description and specific examples are intended for purposes of illustration only and are not intended to limit the scope of the disclosure.

DETAILED DESCRIPTION

Figure 1A:
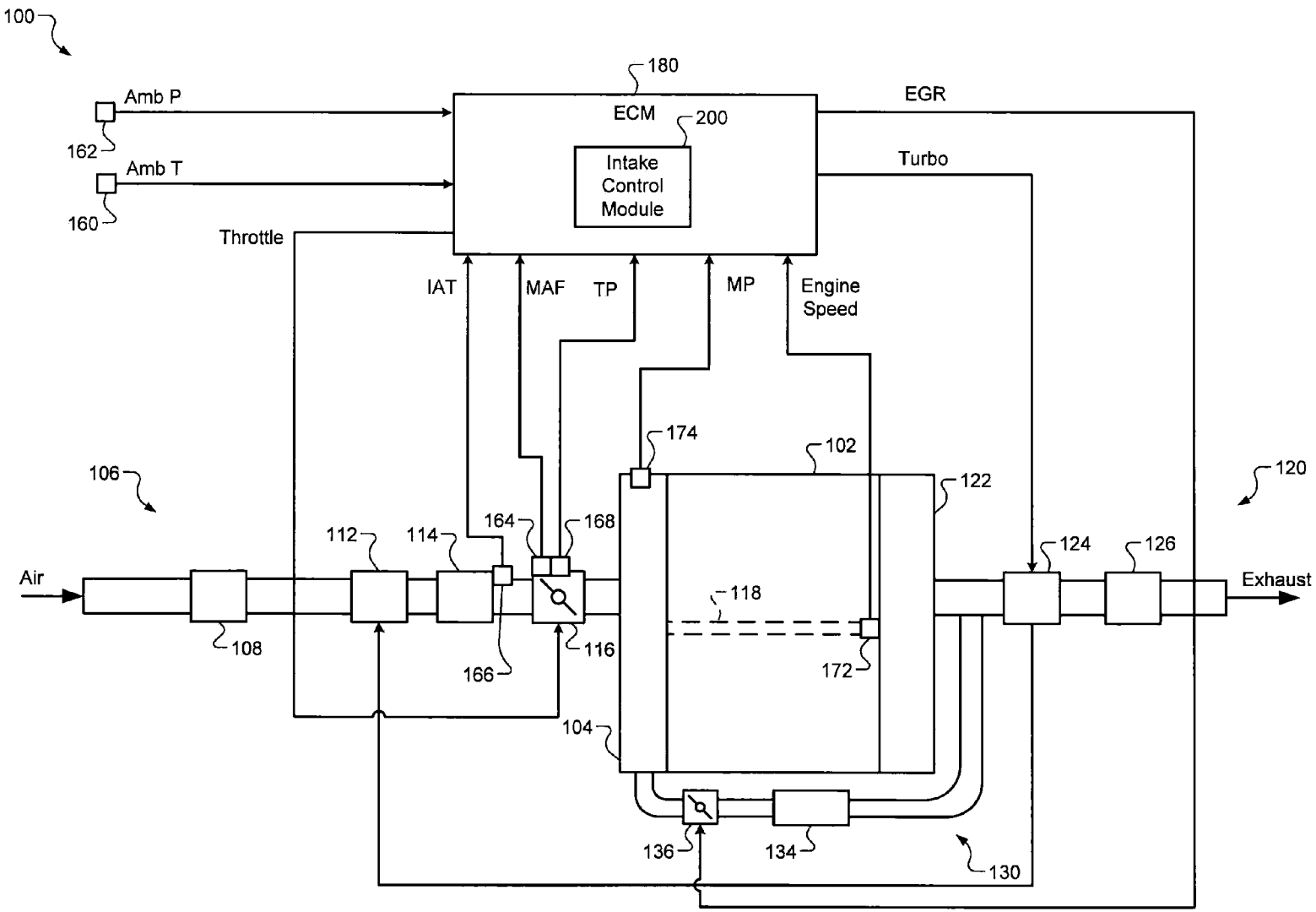
FIGS. 1A-1B are functional block diagrams of exemplary engine systems according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

An engine control module (ECM) controls the torque output by an internal combustion engine. The ECM controls one or more engine actuators to control the torque output of the engine. For example only, the ECM may control a throttle valve, a turbocharger, an EGR valve, and other suitable engine actuators.

The ECM controls the turbocharger based on boost provided by the turbocharger and a compressor outlet pressure. For example only, the ECM may control the turbocharger to achieve a target boost and a target compressor outlet pressure. Some engine systems may include a compressor outlet pressure sensor that measures the compressor outlet pressure downstream of the turbocharger and upstream of the throttle valve. For example only, the compressor outlet pressure sensor may measure the compressor outlet pressure between a compressed air charge cooler (e.g., an aftercooler) and the throttle valve.

In engine systems including the compressor outlet pressure sensor, the ECM estimates a pressure within an intake manifold of the engine (i.e., a manifold pressure) based on the compressor outlet pressure. The ECM may estimate the manifold pressure even in engine systems that also include a manifold pressure sensor. The ECM determines the boost based on the estimated manifold pressure. The compressor outlet pressure sensor may be omitted in some engine systems, and the ECM may receive the manifold pressure measured by a manifold pressure sensor. The ECM estimates the compressor outlet pressure based on the manifold pressure measured by the manifold pressure sensor.

Controlling the turbocharger based on the estimated pressure provides accurate control of the boost provided by the turbocharger and the compressor outlet pressure. Accurate control of the boost and the compressor outlet pressure increases accuracy in controlling flow rate of exhaust gas recirculation (EGR) back to the intake manifold as the EGR flow rate is, among other things, a function of the manifold pressure. Accurate control of the EGR flow rate enables a more accurate prediction of concentration of nitrogen oxides (NOx) in the exhaust gas.

Figure 1B:
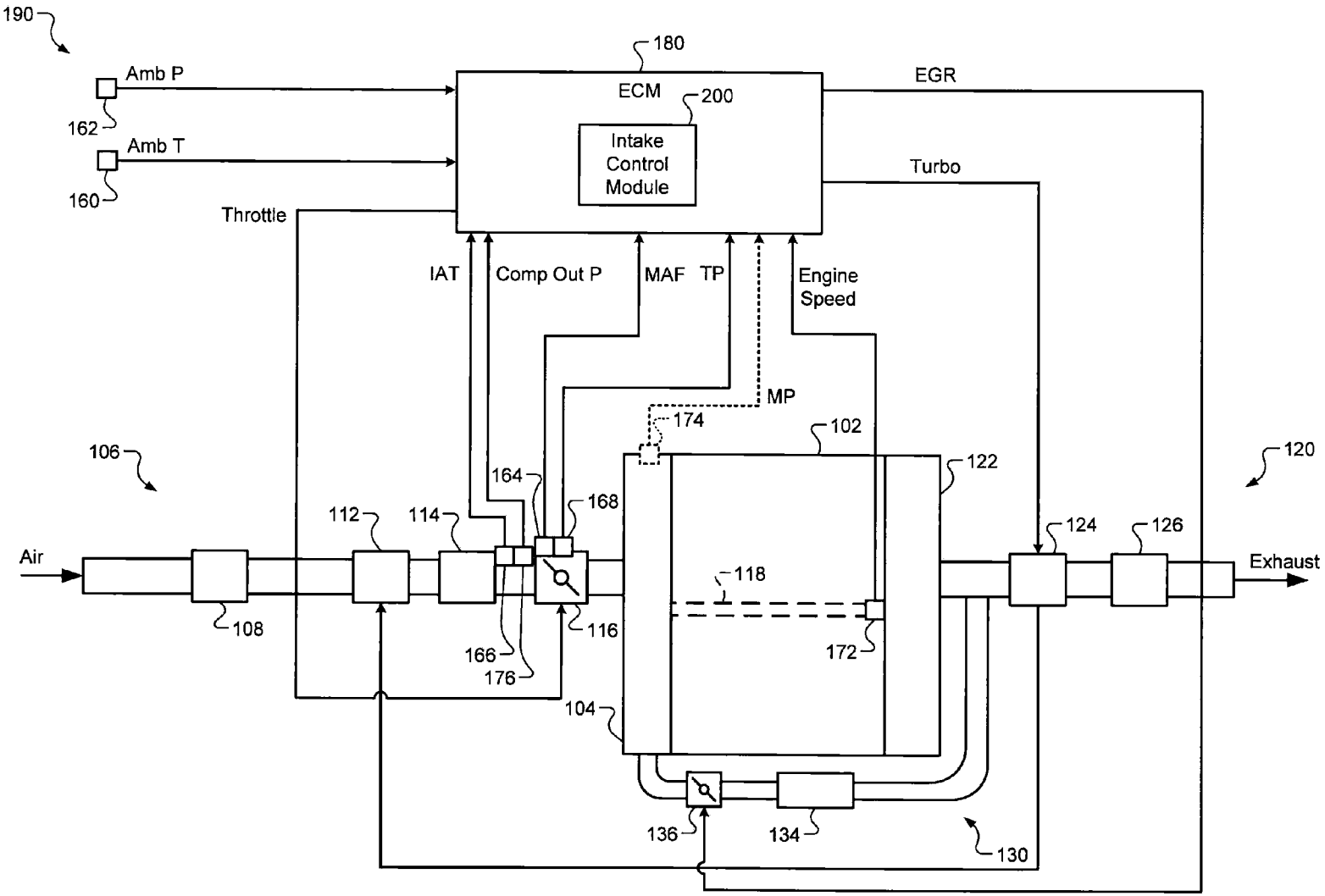

Referring now to FIGS. 1A-1B, functional block diagrams of exemplary engine systems 100 and 190 are presented. An engine 102 combusts an air/fuel mixture within one or more cylinders (not shown) to produce drive torque for a vehicle. The engine 102 may include a diesel engine system or another suitable type of engine. One or more electric motors (not shown) may also be implemented. Air is drawn into the engine 102 through an intake manifold 104. More specifically, air is drawn into the intake manifold 104 via an intake system 106.

The intake system 106 may include an air filter 108, turbocharger compressor 112, an aftercooler 114 (i.e., a compressed air charge cooler), and a throttle valve 116. While not specifically recited, the intake system 106 may also include connecting devices (e.g., pipes) that connect the components of the intake system 106 together. Air being drawn into the intake manifold 104 may encounter the components of the intake system 106 in the following order: first, the air filter 108; second, the turbocharger compressor 112; third, the aftercooler 114; fourth, the throttle valve 116; and fifth, the intake manifold 104.

The turbocharger compressor 112 receives fresh air and compresses the air. In this manner, the turbocharger compressor 112 provides a compressed air charge to the aftercooler 114. The compression of the air generates heat. The compressed air charge may also receive heat from other heat sources, such as exhaust. The aftercooler 114 cools the compressed air and provides cooled compressed air to the throttle valve 116. Opening of the throttle valve 116 is regulated to control the flow of the cooled compressed air to the intake manifold 104.

Gas from the intake manifold 104 (e.g., air or an air/exhaust gas mixture) is drawn into the one or more cylinders of the engine 102. Fuel is also provided for the one or more cylinders. For example only, the fuel may be injected directly into each cylinder of the engine 102, into the intake manifold 104, or at another suitable location. Combustion of an air/fuel mixture drives a rotating crankshaft 118, thereby generating drive torque.

The byproducts of combustion are exhausted from the engine 102 to an exhaust system 120. The exhaust system 120 includes an exhaust manifold 122, a turbocharger turbine 124, and a particulate filter (PF) 126. While not specifically recited, the exhaust system 120 may also include connecting devices (e.g., pipes) that connect the components of the exhaust system 120 together. Exhaust gas traveling through the exhaust system 120 may encounter the components of the exhaust system 120 in the following order: first, the exhaust manifold 122; second, the turbocharger turbine 124; and third, the PF 126.

The flow of the exhaust gas drives rotation of the turbocharger turbine 124. The turbocharger turbine 124 is linked to the turbocharger compressor 112, and the rotation of the turbocharger turbine 124 drives rotation of the turbocharger compressor 112. The turbocharger may include a variable geometry turbocharger (VGT), a variable nozzle turbocharger (VNT), a variable vane turbocharger (VVT), a fixed geometry turbocharger, a sliding vane turbocharger, or another suitable type of turbocharger. For example only, vanes or other components of the turbocharger turbine 124 may be adjusted to be more or less driven by the flow of the exhaust gas.

The PF 126 filters various components from the exhaust gas (e.g., soot). For example only, the PF 126 may include a diesel particulate filter (DPF). While not shown, one or more other components may also be implemented in the exhaust system 120, such as an oxidation catalyst, a selective catalytic reduction (SCR) catalyst, and a heater.

The engine system 100 also includes an exhaust gas recirculation (EGR) system 130. The EGR system 130 controls circulation of exhaust gas from upstream of the turbocharger turbine 124 back to the intake manifold 104. In this manner, the EGR system 130 provides exhaust gas back to the intake manifold 104 to be re-introduced to the engine 102. Recirculating exhaust gas back to the engine 102 produces lower combustion temperatures which, in turn, produces exhaust gas having lower concentrations of nitrogen oxides (NOx).

The EGR system 130 may include an EGR cooler/cooler bypass 134 and an EGR valve 136. While not specifically recited, the EGR system 130 also includes connecting devices (e.g., pipes) that connect the components of the EGR system 130 together. Exhaust gas may flow from a location between the exhaust manifold 122 and the turbocharger turbine 124 to the EGR cooler/cooler bypass 134.

The EGR cooler/cooler bypass 134 may include an EGR cooler and a cooler bypass valve. The cooler bypass valve may be selectively opened to allow exhaust gas to bypass the EGR cooler. The EGR cooler enables cooling of exhaust gas passing through the EGR cooler. Exhaust gas flows from the EGR cooler/cooler bypass 134 to the EGR valve 136. Opening of the EGR valve 136 may be controlled to regulate circulation of exhaust gas back to the intake manifold 104. In other words, the opening of the EGR valve 136 may be controlled to regulate a flow rate of exhaust gas back to the intake manifold 104 (i.e., an EGR flow rate). For example only, the EGR flow rate may be controlled to achieve a desired ratio of exhaust gas to fresh air drawn into a cylinder for a combustion event.

One or more sensors may be implemented to measure operating parameters. For example only, the engine systems 100 and 190 may include an ambient air temperature sensor 160, an ambient pressure sensor 162, a mass airflow (MAF) sensor 164, and an intake air temperature (IAT) sensor 166. The engine systems 100 and 190 may also include a throttle position (TP) sensor 168 and a crankshaft position sensor 172.

The ambient air temperature sensor 160 measures the temperature of ambient (i.e., atmospheric) air and generates an ambient air temperature signal based on the ambient air temperature. The ambient pressure sensor 162 measures pressure of the ambient air and generates an ambient pressure signal based on the ambient air pressure.

The MAF sensor 164 measures mass flow rate of air flowing through the throttle valve 116 and generates a MAF signal based on the mass flow rate. The IAT sensor 166 measures temperature of air flowing through the throttle valve 116 and generates an IAT signal based on the temperature. The TP sensor 168 measures position (e.g., throttle opening) of the throttle valve 116 and generates a TP signal based on the position of the throttle valve 116.

The crankshaft position sensor 172 measures position of the crankshaft 118 and generates a crankshaft position signal based on the position of the crankshaft 118. For example only, the crankshaft position sensor 172 may generate pulses based on rotation of the crankshaft 118. Engine speed in revolutions per minute (RPM) may be determined based on the pulses.

In the engine systems 100 and 190, an additional pressure may also be measured using a sensor. A manifold pressure sensor 174 measures pressure within the intake manifold 104 in the engine system 100. For example only, the manifold pressure sensor 174 may measure manifold absolute pressure (MAP). In the engine system 190 of the exemplary embodiment of FIG. 1B, a compressor outlet pressure sensor 176 measures a compressor outlet pressure. For example only, the compressor outlet pressure sensor 176 may measure the compressor outlet pressure near an outlet of the aftercooler 114 or at another suitable location, such as between the aftercooler 114 and the throttle valve 116. The manifold pressure sensor 174 and the compressor outlet pressure sensor 176 generate manifold pressure (MP) and compressor outlet pressure (Comp out p) signals, respectively.

An engine control module (ECM) 180 controls the torque output by the engine 102. The ECM 180 controls one or more engine actuators to control the torque output of the engine 102. For example only, the ECM 180 may control the throttle valve 116, the turbocharger, the EGR valve 136, the provision of fuel, and other suitable parameters.

The ECM 180 of the present disclosure includes an intake control module 200. The intake control module 200 receives a manifold pressure measured by the manifold pressure sensor 174 or a compressor outlet pressure measured by the compressor outlet pressure sensor 176.

When the compressor outlet pressure measured by the compressor outlet pressure sensor 176 is received, the intake control module 200 estimates the manifold pressure based on the compressor outlet pressure. The intake control module 200 estimates the manifold pressure based on the compressor outlet pressure measured by the compressor outlet pressure sensor 176 even in systems where the intake control module 200 also receives the manifold pressure measured by the manifold pressure sensor 174. The intake control module 200 then selectively controls the turbocharger based on the estimated manifold pressure.

When the manifold pressure measured by the manifold pressure sensor 174 is received, the intake control module 200 estimates the compressor outlet pressure based on the manifold pressure. The intake control module 200 controls the turbocharger based on the estimated compressor outlet pressure.

Estimating the pressure on one side of the throttle valve 116 based on the pressure measured on the other side of the throttle valve 116 provides an accurate indicator of the pressure on the one side of the throttle valve 116. Controlling the turbocharger based on the estimated pressure provides accurate control of boost provided by the turbocharger and the flow rate of exhaust gas flowing back to the intake manifold 104 during both steady-state and transient conditions.

Additionally, the accurate control of the boost enables the EGR flow rate to be controlled more accurately and variation in the EGR flow rate to be reduced as the EGR flow rate is, among other things, a function of the manifold pressure. Smaller variation in the EGR flow rate provides more predictable concentrations of nitrogen oxides (NOx) in the exhaust. The present disclosure potentially enables a decrease in consumption of a dosing agent (e.g., urea) that is injected into the exhaust system 120 to react with NOx. Smaller variation in the EGR flow rate also reduces the likelihood of production of smoke (e.g., soot) by the vehicle. Accordingly, the present disclosure may provide for a decrease in fuel consumption due to less frequent need for regeneration of the PF 126.

Figure 2A:
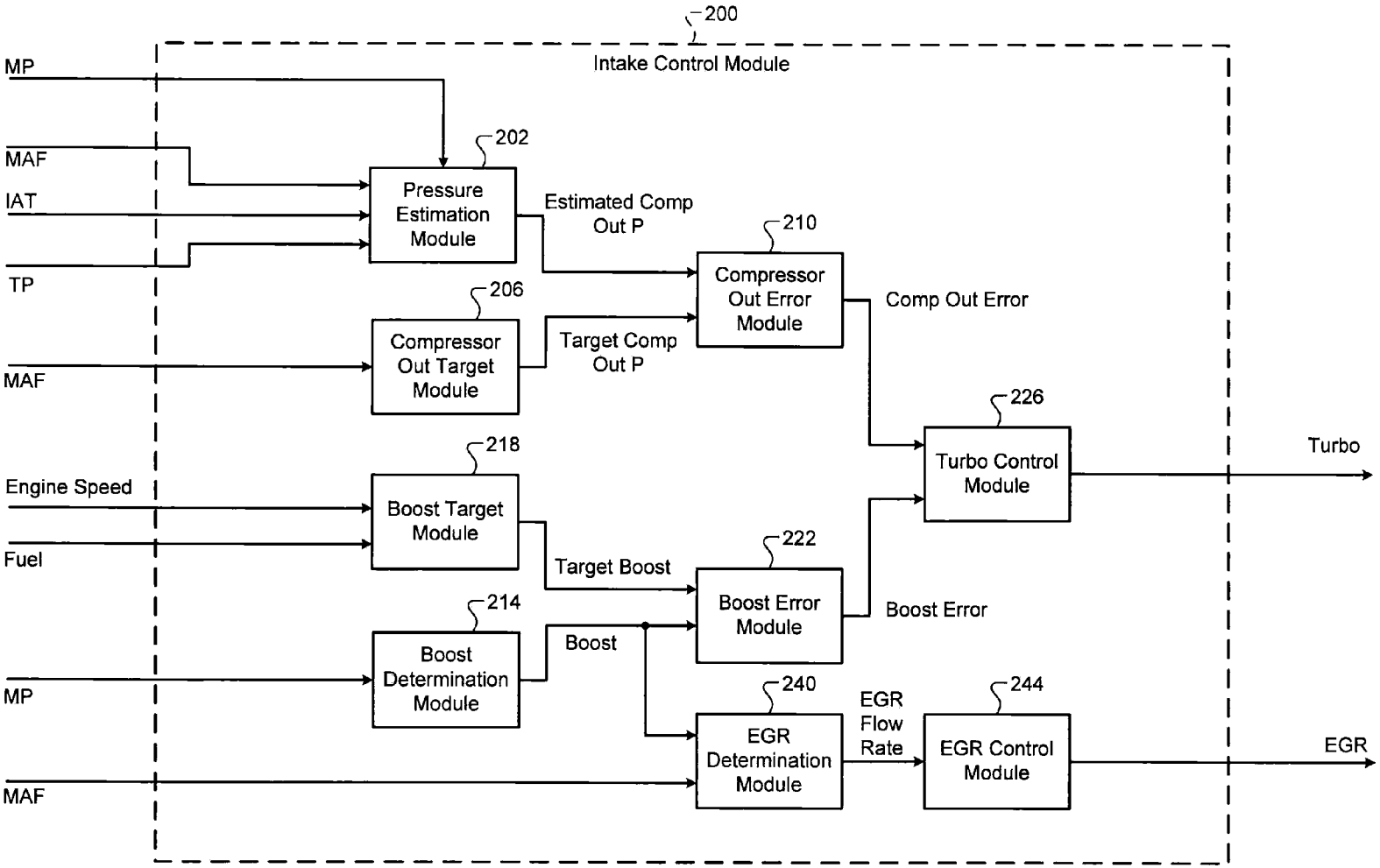
FIGS. 2A-2B are functional block diagrams of exemplary intake control systems according to the principles of the present disclosure.

Referring now to FIG. 2A, a functional block diagram of an exemplary implementation of the intake control module 200 is presented. The intake control module 200 includes a pressure estimation module 202, a compressor out target module 206, and a compressor out error module 210. The intake control module 200 also includes a boost determination module 214, a boost target module 218, a boost error module 222, and a turbo control module 226.

The pressure estimation module 202 receives the manifold pressure from the manifold pressure sensor 174. The pressure estimation module 202 estimates the compressor outlet pressure (Estimated comp out p) based on the manifold pressure. For example only, the pressure estimation module 202 may estimate the compressor outlet pressure based on the manifold pressure as a function of the MAF, the intake air temperature, and the throttle position. The pressure estimation module 202 may also apply one or more filters and/or buffers before outputting the estimated compressor outlet pressure.

The compressor out target module 206 determines a target for the compressor outlet pressure (Target comp out p). The compressor out target module 206 may determine the target compressor outlet pressure based on, for example, the MAF. For example only, the compressor out target module 206 may determine the target compressor out pressure to adjust the MAF toward a target MAF.

The compressor out error module 210 determines a compressor outlet pressure error (Comp out error) based on the estimated compressor outlet pressure and the target compressor outlet pressure. For example only, the compressor out error module 210 may determine the compressor outlet pressure error based on a difference between the estimated compressor outlet pressure and the target compressor outlet pressure. The compressor out error module 210 provides the compressor outlet pressure error to the turbo control module 226.

The boost determination module 214 determines the boost provided by the turbocharger. The boost of the turbocharger may refer to an increase in the manifold pressure provided by the turbocharger. In other words, the boost may refer to the difference between the manifold pressure of a naturally aspirated engine under the current operating conditions and the manifold pressure of the engine 102 under the current operating conditions.

The boost determination module 214 may determine the boost based on the manifold pressure measured by the manifold pressure sensor 174. The boost determination module 214 may also determine the boost based on, for example, the manifold pressure of a naturally aspirated engine, the ambient air pressure, and/or other suitable parameters.

The boost target module 218 determines a target for the boost of the turbocharger (Target boost). The boost target module 218 may determine the target boost based on, for example, the engine speed and the amount (or rate) of fuel being provided. The boost error module 222 determines a boost error based on the boost and the target boost. For example only, the boost error module 222 may determine the boost error based on a difference between the boost and the target boost. The boost error module 222, like the compressor out error module 210, provides the boost error to the turbo control module 226.

The turbo control module 226 controls the turbocharger based on the compressor outlet pressure error and the boost error. For example only, the turbo control module 226 may control the turbocharger to adjust both the compressor outlet pressure error and the boost error towards zero. In other words, the turbo control module 226 may adjust the turbocharger to adjust the estimated compressor outlet pressure towards the target compressor outlet pressure and to adjust the boost toward the target boost. The turbo control module 226 may control the turbocharger by, for example, adjusting the geometry, the nozzle(s), the vanes, or another suitable parameter of the turbocharger.

The intake control module 200 may also include an EGR determination module 240 and an EGR control module 244. The EGR determination module 240 may determine a mass flow rate of exhaust gas being recirculated back to the engine 102 (EGR flow rate). For example only, the EGR determination module 240 may determine the EGR flow rate based on the boost and the MAF.

The EGR control module 244 may control the opening of the EGR valve 136 based on the EGR flow rate. For example only, the EGR control module 244 may control the opening of the EGR valve 136 to adjust the EGR flow rate to a target EGR flow rate. The target EGR flow rate may be set, for example, to achieve a desired ratio of exhaust gas to fresh air provided to a cylinder for a combustion event.

Figure 2B:
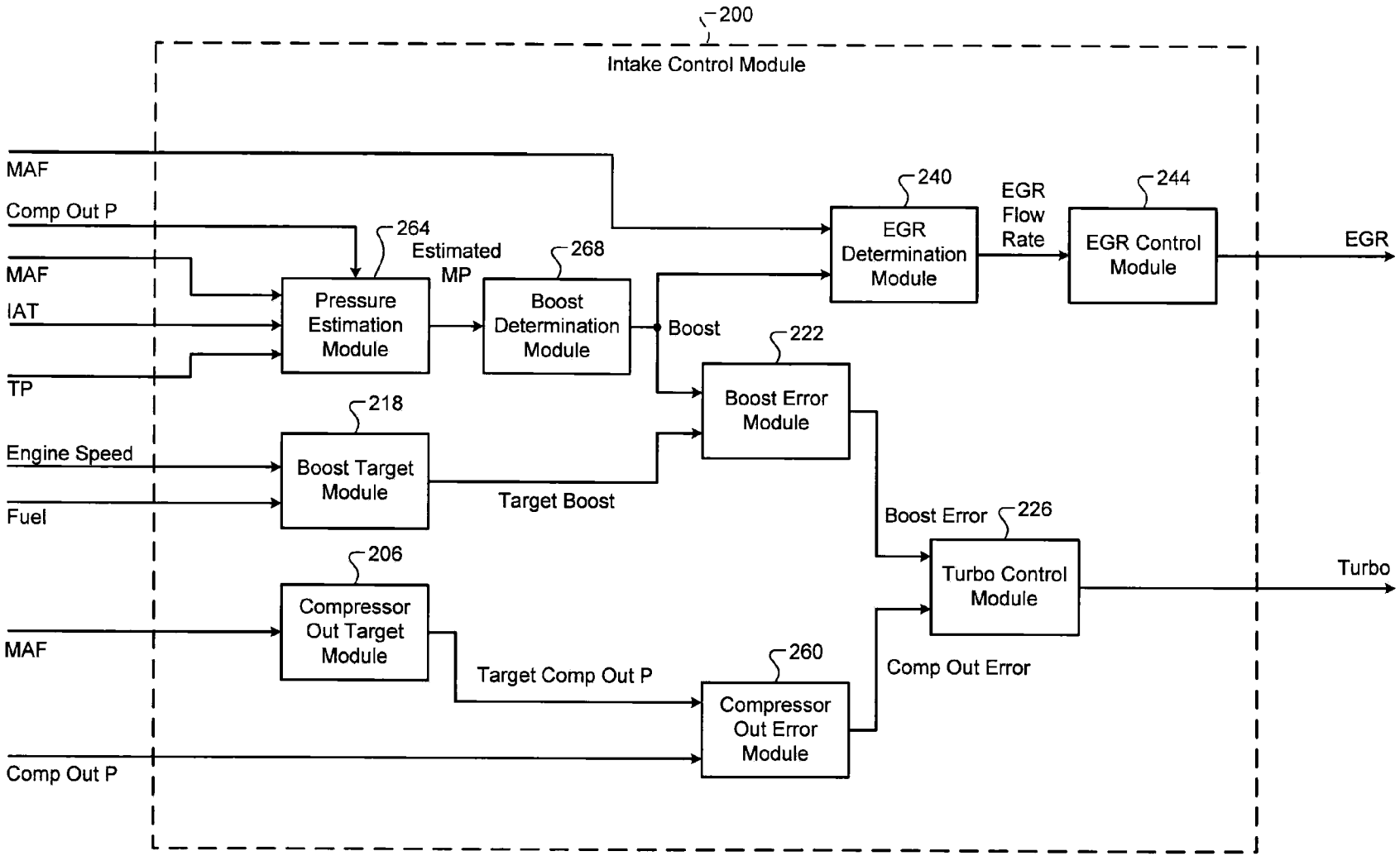

Referring now to FIG. 2B, a functional block diagram of another exemplary implementation of the intake control module 200 is presented. The intake control module 200 of the exemplary embodiment of FIG. 2B includes the compressor out target module 206, the boost target module 218, the boost error module 222, and the turbo control module 226. The intake control module 200 also includes a compressor out error module 260, a pressure estimation module 264, and a boost determination module 268.

The compressor out target module 206 determines the target compressor outlet pressure. The compressor out error module 260 receives the target compressor outlet pressure from the compressor out target module 206 and the compressor outlet pressure measured by the compressor outlet pressure sensor 176.

The compressor out error module 260 determines the compressor outlet pressure error based on the target compressor outlet pressure and the compressor outlet pressure. For example only, the compressor out error module 260 may determine the compressor outlet pressure error based on a difference between the target compressor outlet pressure and the compressor outlet pressure. The compressor out error module 260 provides the compressor outlet pressure error to the turbo control module 226.

The boost target module 218 determines the target boost. The pressure estimation module 264 receives the compressor outlet pressure and estimates the manifold pressure (Estimated MP) based on the compressor outlet pressure. For example only, the pressure estimation module 264 may estimate the manifold pressure based on the compressor outlet pressure as a function of the MAF, the intake air temperature, and the throttle position. The pressure estimation module 264 may also apply one or more filters and/or buffers before outputting the estimated manifold pressure.

The boost determination module 268 determines the boost of the turbocharger based on the estimated manifold pressure. The boost determination module 268 may determine the boost further based on, for example, the ambient pressure, the manifold pressure of a naturally aspirated engine under the current operating conditions, and/or other suitable parameters.

The boost error module 222 receives the boost and target boost and determines the boost error based on the boost and the target boost. The boost error module 222, like the compressor out error module 260, provides the boost error to the turbo control module 226. The turbo control module 226 controls the turbocharger based on the boost error and the compressor outlet pressure error.

Figure 3A:
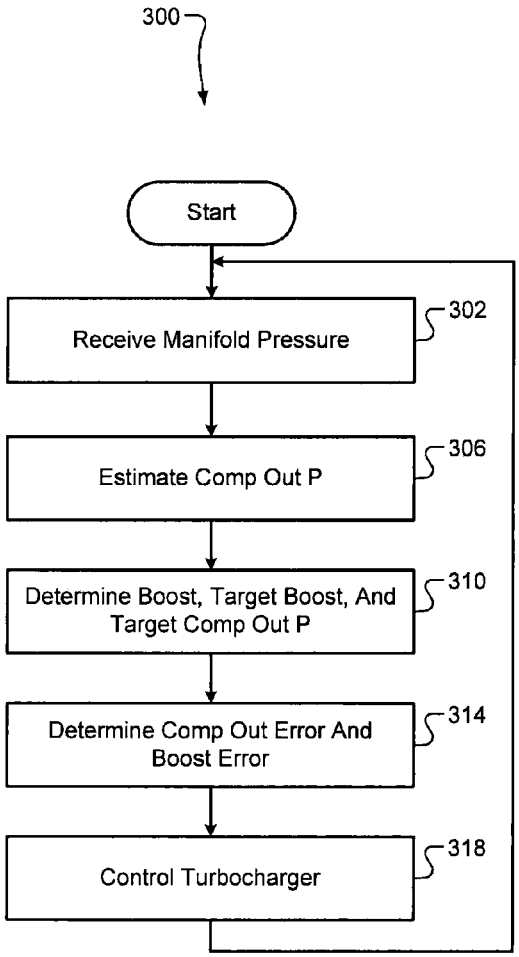
FIGS. 3A-3B are flowcharts depicting exemplary steps performed by methods according to the principles of the present disclosure.

Referring now to FIG. 3A, a flowchart of exemplary steps performed by a method 300 is presented. Control may begin in step 302 where control receives the manifold pressure measured by the manifold pressure sensor 174. Control may then proceed to step 306 where control estimates the compressor outlet pressure. For example only, control may estimate the compressor outlet pressure based on the manifold pressure as a function of the MAF, the intake air temperature, and the throttle position.

Control determines the boost, the target boost, and the target compressor outlet pressure in step 310. Control determines the compressor outlet pressure error and the boost error in step 314. For example only, control may determine the compressor outlet pressure error based on a difference between the target compressor outlet pressure and the estimated compressor outlet pressure, and control may determine the boost error based on a difference between the boost and the target boost. Control controls the turbocharger in step 318. More specifically, control controls the turbocharger based on the compressor outlet pressure error and the boost error. For example only, control may adjust the turbocharger to adjust the compressor outlet pressure error and the boost error toward zero.

Figure 3B:
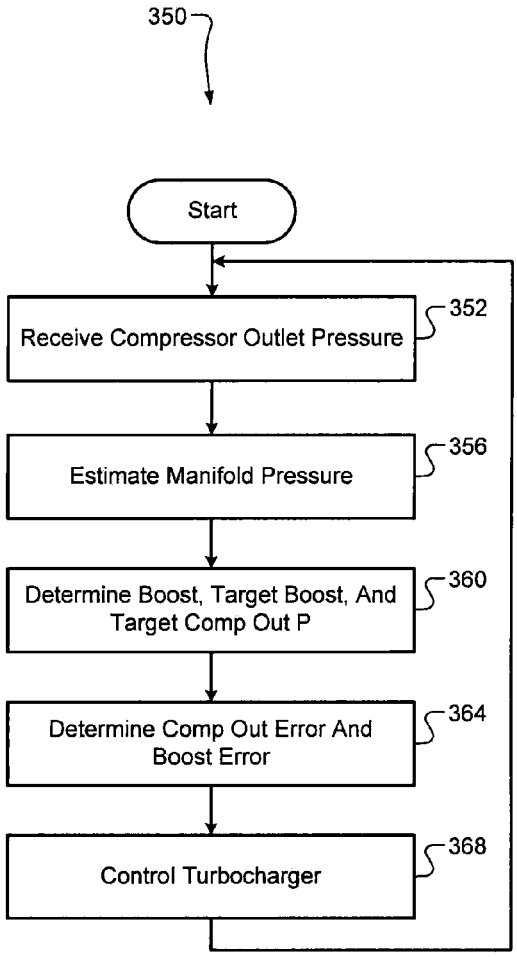

Referring now to FIG. 3B, another flow chart of exemplary steps performed by a method 350 is presented. Control may begin in step 352 where control receives the compressor outlet pressure measured by the compressor outlet pressure sensor 176. Control may then proceed to step 356 where control estimates the manifold pressure based on the compressor outlet pressure. Control may estimate the manifold pressure based on the compressor outlet pressure even in engine systems including both a manifold pressure sensor and a compressor outlet pressure sensor.

Control determines the boost, the target boost, and the target compressor outlet pressure in step 360. Control determines the compressor outlet pressure error and the boost error in step 364. For example only, control may determine the compressor outlet pressure error based on a difference between the target compressor outlet pressure and the estimated compressor outlet pressure, and control may determine the boost error based on a difference between the boost and the target boost. Control controls the turbocharger in step 368. More specifically, control controls the turbocharger based on the compressor outlet pressure error and the boost error. For example only, control may adjust the turbocharger to adjust the compressor outlet pressure error and the boost error toward zero.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An intake control system for a vehicle, comprising:

a first electronic circuit configured to receive a pressure measured by a compressor outlet pressure sensor at a location downstream from a compressor of a turbocharger and upstream from a throttle valve and to estimate a manifold pressure within an intake manifold of an engine based on the pressure;

a second electronic circuit configured to determine boost provided by the turbocharger based on the estimated manifold pressure; and a third electronic circuit configured to control the turbocharger based on the estimated manifold pressure, a first difference between the boost and a target boost, and a second difference between the pressure measured by the compressor outlet pressure sensor and a target compressor outlet pressure.

2. The intake control system of claim 1 wherein the first electronic circuit is configured to estimate the manifold pressure further based on a flow rate of air through the throttle valve, an air temperature, and an opening amount of the throttle valve.

3. The intake control system of claim 1 wherein the first, second, and third electronic circuits include at least one of an Application Specific Integrated Circuit (ASIC), a processor and memory including code, and a combinational logic circuit.

4. An engine system comprising:

the intake system of claim 1; and a manifold pressure sensor that measures the manifold pressure within the intake manifold.

5. The intake control system of claim 1 further comprising:

a fourth electronic circuit configured to determine an exhaust gas recirculation (EGR) flow rate back to the intake manifold based on the boost; and a fifth electronic circuit configured to control opening of an EGR valve based on the EGR flow rate.

6. The intake control system of claim 5 wherein the fourth electronic circuit is configured to determine the EGR flow rate further based on a flow rate of air through the throttle valve.

7. An intake control method comprising:

receiving a pressure measured by a compressor outlet pressure sensor at a location downstream from a compressor of a turbocharger and upstream from a throttle valve;

estimating a manifold pressure within an intake manifold of an engine based on the pressure;

determining boost provided by the turbocharger based on the estimated manifold pressure; and controlling the turbocharger based on the estimated manifold pressure, a first difference between the boost and a target boost, and a second difference between the pressure measured by the compressor outlet pressure sensor and a target compressor outlet pressure.

8. The intake control method of claim 7 further comprising estimating the manifold pressure further based on a flow rate of air through the throttle valve, an air temperature, and an opening amount of the throttle valve.

9. The intake control method of claim 7 further comprising measuring the manifold pressure within the intake manifold using a manifold pressure sensor.

10. The intake control method of claim 7 further comprising:

determining a flow rate of exhaust gas recirculation (EGR) back to the intake manifold based on the boost; and controlling opening of an EGR valve based on the flow rate.

11. The intake control method of claim 10 further comprising determining the flow rate of the EGR further based on a flow rate of air through the throttle valve.

* * * * *